US005251593A

United States Patent [19]

Pedersen

[11] Patent Number: 5,251,593

[45] Date of Patent: Oct. 12, 1993

[54] THERMODYNAMIC LIQUID RING MACHINE

[76] Inventor: John R. Pedersen, 3 Priors Rd., Cheltenham Gloucestershire, United Kingdom

[21] Appl. No.: 776,273

[22] PCT Filed: May 30, 1990

[86] PCT No.: PCT/GB90/00835

§ 371 Date: Nov. 26, 1991

§ 102(e) Date: Nov. 26, 1991

[87] PCT Pub. No.: WO90/15250

PCT Pub. Date: Dec. 13, 1990

[30] Foreign Application Priority Data

May 31, 1989 [GB] United Kingdom ..... 8912505

[51] Int. Cl.[5] ..... F02B 53/00; F04B 37/00

[52] U.S. Cl. ..... 123/204; 123/234; 123/241; 417/68

[58] Field of Search ..... 417/68, 69; 123/204, 123/228, 234, 241; 60/89, 161, 39.6, 39.63, 45 R

[56] References Cited

U.S. PATENT DOCUMENTS

| | | | |
|---|---|---|---|
| 1,094,919 | 4/1914 | Nash | 123/204 |
| 1,174,439 | 3/1916 | Pelley | 60/39.161 |
| 1,302,138 | 4/1919 | Cooper | 60/39.6 |
| 1,603,613 | 10/1926 | Lee | 123/241 |
| 1,668,532 | 5/1928 | Stewart | 417/68 |
| 1,919,252 | 7/1933 | Paget . | |
| 2,231,912 | 2/1941 | Holzwarth | 60/39.161 |
| 3,108,738 | 10/1963 | Lühmann | 417/68 |
| 3,240,017 | 3/1966 | Boissevain et al. | 417/68 |

FOREIGN PATENT DOCUMENTS

| | | | |
|---|---|---|---|
| 257375 | 2/1911 | Fed. Rep. of Germany | 417/68 |
| 254686 | 1/1912 | Fed. Rep. of Germany | 417/68 |
| 59937 | 9/1954 | France | 417/68 |
| 58-2494 | 1/1983 | Japan | 417/68 |
| 2439796 | 4/1976 | Netherlands | 60/39.6 |
| 38715 | 12/1912 | Sweden | 417/68 |
| 788378 | 1/1958 | United Kingdom . | |
| WO89/12168 | 12/1989 | World Int. Prop. O. . | |

*Primary Examiner*—Richard A. Bertsch
*Assistant Examiner*—Roland G. McAndrews, Jr.
*Attorney, Agent, or Firm*—Young & Thompson

[57] ABSTRACT

A liquid ring machine comprises an outer drum having a cylindrical outer wall 1 surrounding a central axis 2, a vaned rotor 3 rotatable within the drum about an axis 4 which is parallel to, but offset from, the central axis 2 of the drum, and a liquid disposed within the drum such that, when the rotor 3 rotates at a sufficient speed, the liquid forms a rotating ring 5 adjacent the outer wall 1 of the drum. The ends of the vanes 6 on the rotor are maintained in contact with the liquid during such rotation so that a series of chambers 8 is formed between the vanes 6 of the rotor 3. The chambers 8 are bounded at the outer periphery by the liquid ring 5 and vary in volume in dependence on the angular orientation of the rotor 3 in view of the offset between the axis 4 of rotation of the rotor and the central axis 2 of the drum. An inlet 23 and an outlet 25 are provided by means of which a working fluid is introduced into, and discharged from, each of the chambers 8 at appropriate angular positions of the rotor 3. Furthermore at least the cylindrical outer wall 1 of the drum is freely rotatable about the central axis 2 to enable the outer wall to be rotated by the liquid ring 5.

8 Claims, 3 Drawing Sheets

THERMODYNAMIC LIQUID RING MACHINE

FIELD OF THE INVENTION

This invention relates to liquid ring machines, and is concerned more particularly with a liquid ring thermodynamic machine capable of producing work in response to input of heat, as in an engine, or requiring input of work to produce cooling, as in a refrigerator.

BACKGROUND OF THE INVENTION

Liquid ring machines are known per se, and conventionally comprise a vaned rotor which is rotatable within a cylindrical drum with the ends of the vanes being maintained in contact with a liquid ring during such rotation. The liquid ring forms a closed chamber with each pair of adjacent vanes on the rotor, and the volume of this chamber varies in dependence on the angular orientation of the rotor due to the fact that the axis of rotation of the rotor is offset from the central axis of the drum. It will be appreciated that such a machine may be used either to compress a working fluid or to provide controlled expansion of the fluid depending on the angular positions at which the fluid depending on the angular positions at which the fluid is introduced into, and discharged from, each chamber.

The functioning of such a liquid ring machine is well known in the art. However, the application of such machines is limited by the fact that they are generally of relatively low efficiency compared with other types of machine, the best efficiency of a typical machine generally being no more than about 50%.

A significant factor affecting the efficiency of such machines is the severe mechanical losses which arise due to the drag on the rotating liquid ring exerted by the adjacent walls of the outer drum. WO 89/12168, published 14 Dec. 1989, discloses a liquid ring compressor in which the drum is rotatable with the liquid ring to reduce the drag on the liquid ring.

It is an object of the invention to provide a liquid ring thermodynamic machine of increased efficiency.

SUMMARY OF THE INVENTION

According to the present invention there is provided a liquid ring machine having at least one liquid ring assembly comprising a drum having a cylindrical wall surrounding a central axis, a vaned rotor rotatable within the drum about an axis which is parallel to, but offset from, the central axis of the drum, and a liquid disposed within the drum such that, when the rotor rotates at a sufficient speed, the liquid forms a rotating ring adjacent the cylindrical wall of the drum and the ends of the vanes on the rotor are maintained in contact with the liquid during such rotation so that a series of chambers is formed between the vanes of the rotor, the chambers being bounded at the outer periphery by the liquid ring and varying in volume in dependence on the angular orientation of the rotor in view of the offset between the axis of rotation of the rotor and the central axis of the drum, and inlet and outlet means by means of which a working fluid is introduced into, and discharged from, each of the chambers at appropriate angular positions of the rotor, wherein at least the cylindrical wall of the drum is freely rotatable about the central axis to enable the cylindrical wall to be rotated by the liquid ring, characterised in that the liquid ring machine is a thermodynamic machine which comprises a liquid ring compression part having an inlet for fluid and an outlet for compressed fluid, and a liquid ring expansion part having an inlet for fluid and an outlet for expanded fluid, the liquid ring compression part and the liquid ring expansion part being formed by respective portions of said liquid ring assembly or by respective said liquid ring assemblies.

Such a thermodynamic machine has low friction losses and therefore high efficiency. Where the machine is an engine, it will have a large power output in relation to its size and weight, so that such an engine can be used with advantage in a number of applications, such as in microlight aircraft, where high power output in relation to weight is required.

Since the cylindrical wall of the drum can rotate at a speed practically matching the speed of rotation of the liquid ring, the drag on the rotating liquid ring exerted by the wall of the drum is minimised, and the efficiency of the machine at a given rotational speed is greatly increased as compared with conventional liquid ring machines. This greatly increases the range of possible applications for the machine as a consequence of the following advantages obtainable with machines in accordance with the invention as compared with the conventional machines.

(i) Much higher rotational speeds can be used.

(ii) Increased pressure differences can be supported.

(iii) A greater throughput of working fluid is obtainable for a given machine size.

(iv) A greater range of liquids can be used to form the liquid ring since the viscosity of the liquid is of lesser importance.

Possible applications for machines in accordance with the invention include, but are not limited to, air cycle heat pumps and various forms of heat engine.

In a development of the invention the inside surface of the cylindrical wall of the drum is provided with radially inwardly directed blades or lobes. The provision of such blades or lobes greatly reduces the rate of movement of liquid in response to pressure differences between adjacent chambers so that lower speeds of rotation of the rotor can be used to support given pressure differences than would otherwise be possible.

Preferably the rotor includes a shroud plate which extends perpendicularly to the axis of rotation of the rotor at one axial end of the rotor and which is joined to the corresponding axial end of each vane of the rotor. Such a shroud plate prevents leakage between adjacent chambers at that end of the rotor and permits an axial clearance to be provided between that end of the rotor and the adjacent wall of the drum to simplify manufacture by allowing greater axial tolerance.

In one embodiment of the invention the inlet and outlet means comprise inlet and outlet ports extending through a port plate forming an axial end wall of the drum and communicable with the chambers.

In an alternative embodiment of the invention the inlet and outlet means comprise inlet and outlet ducts extending through a fixed hub and opening on an outer cylindrical surface of the hub so as to be communicable with the chambers by way of ports extending through the rotor and opening on an inner cylindrical surface of the rotor surrounding the outer cylindrical surface of the hub.

BRIEF DESCRIPTION OF THE DRAWINGS

In order that the invention may be more fully understood, preferred embodiments of the invention will now be described, by way of example, with reference to the accompanying drawings, in which.

DETAILED DESCRIPTION OF THE INVENTION

Figure 1:
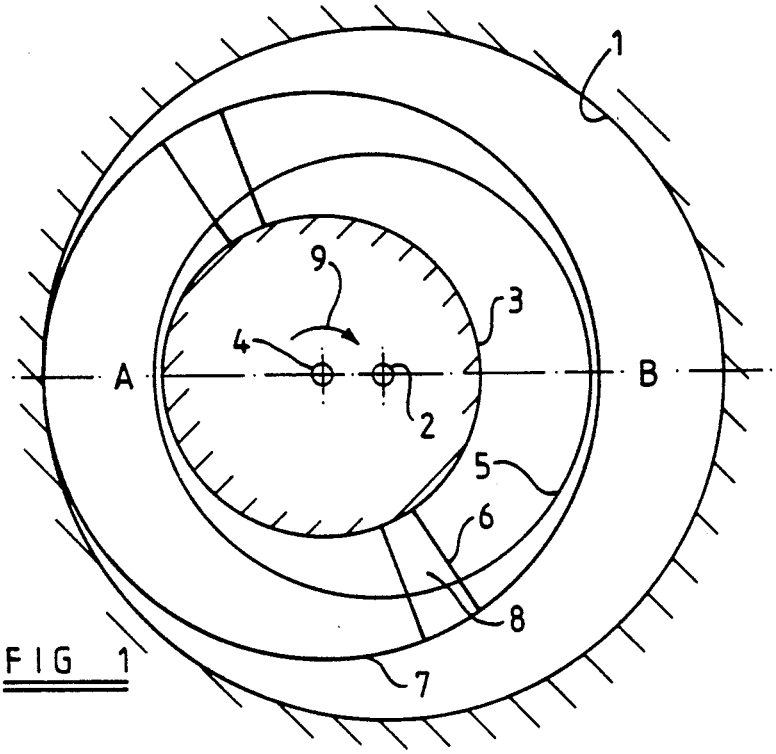
FIG. 1 is a diagrammatic plan view illustrating the general principle of a liquid ring machine.

Referring to FIG. 1, a generalised liquid ring machine comprises an outer drum having a cylindrical outer wall surrounding a central axis 2, a vaned rotor 3 rotatable within the drum about an axis 4 which is parallel to, but offset from, the central axis 2 of the drum, and a liquid which forms a rotating liquid ring 5 adjacent the outer wall 1 of the drum when the rotor 3 rotates at a sufficient speed. In the figure only four vanes 6 are shown on the rotor 3, although it will be appreciated that a much larger number of vanes is provided in practice so that the vanes are equiangularly spaced about the circumference of the rotor 3.

The radial length of each vane 6 is preferably a little greater than twice the distance between the axes 2 and 4 so that the radially outermost ends of the vanes do not emerge from the liquid during rotation of the rotor 3. In the figure the path followed by the ends of the vanes 6 during rotation is shown by the circle 7. Thus a series of chambers, such as 8, is formed between the vanes 6 with the chambers 8 being bounded at the outer periphery by the liquid ring 5 and varying in volume in dependence on the angular rotation of the rotor 3. Thus it will be appreciated that, as the rotor is rotated in the direction of the arrow 9 in the figure, the chamber 8 shown towards the bottom of the figure will move in a clockwise direction and, in so doing, will decrease in volume until it is at a minimum when it reaches an angular position denoted by the letter A in the figure, and will then increase in volume until it reaches an angular position denoted by the letter B in the figure. If a working fluid is introduced into the chamber 8 by way of an inlet at the position A and then discharged by way of an outlet at the position B, the machine will act as an expander, whilst, if the working fluid is introduced to the chamber 8 by way of an inlet at the position B and is discharged by way of an outlet at the position A, the machine will serve as a compressor.

In practice, for a compressor, almost the whole of the half crescent from A to B in the clockwise direction would be exposed to the inlet port, whereas the outlet port would occupy only a short arc extending for a few degrees from the position A in the anti-clockwise direction (corresponding to approximately the width of a single chamber). However, neither the inlet port nor the outlet port actually reaches the position A so that there is always at least one vane 8 between the inlet and outlet ports in the region of A. Similar factors apply to the inlet and outlet ports of an expander. However, the precise positioning of the ports is governed by the angle between the vanes and the required volume ratio of compression or expansion.

Figure 2:
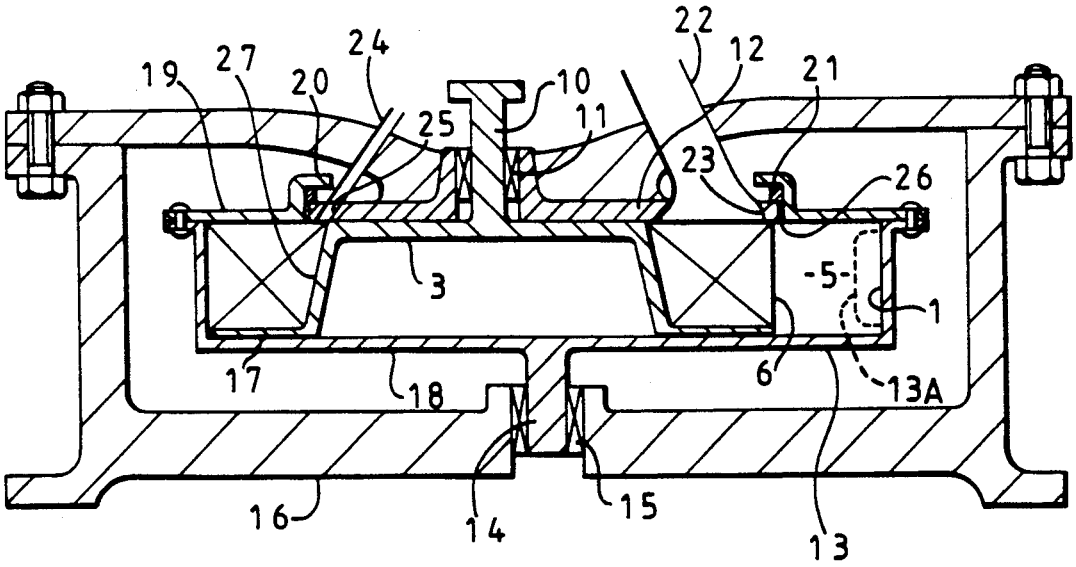
FIG. 2 is an axial section through a liquid ring assembly forming part of a first embodiment of the invention.

FIG. 2 shows a practical embodiment of liquid ring machine in accordance with the invention in which the rotor 3 is mounted on a shaft 10 and is rotatably supported by bearings 11 extending through a fixed port plate 12 of the drum 13. Furthermore the drum 13 is mounted on a shaft 14 rotatably supported by bearings 15 extending through a wall of an outer housing 16. As may be seen in the figure, the vanes 6 on the rotor 3 are approximately rectangular in shape. Furthermore the rotor 3 is provided with an annular shroud plate 17 which extends perpendicularly to the axis of rotation of the rotor and which is joined to one axial end of each of the vanes 6. This prevents any leakage between adjacent chambers at this axial end of the rotor. Furthermore the number of vanes should be great to minimise the pressure difference, and hence the leakage, between adjacent chambers through the clearance between the vanes and the fixed port plate 12 at points where there is no liquid.

It will be seen from the figure that the drum 13 comprises a dish-shaped base 18 and an annular cover plate 19 secured thereto. The cover plate 19 has a raised inner rim 20 which is sealed in relation to the outer periphery of the fixed port plate 12 by an annular seal 21 so as to permit rotation of the drum 13 relative to the port plate 12. Furthermore an inlet duct 22 communicates with an inlet port 23 in the port plate 12 for supply of low pressure fluid to the chambers of the rotor, and an outlet duct 24 communicates with an outlet port 25 in the port plate 12 for discharge of high pressure fluid from the chambers.

It should be noted that the annular gap 26 between the port plate 12 and the cover plate 19 is submerged by the liquid, and this serves to minimise leakage of working fluid through the gap 26. This mechanism is effective because each chamber contains fluid under pressure for only a very short length of time. It is also advantageous to form helical grooves in both the inside surface of the port plate and the inside surface of the cover plate 19 in order to drive the liquid inwards and increase the ability to support fluid under pressure in the chambers.

It will also be seen that the outer surface 27 of the rotor 3 is conically tapered so as to permit the volume of the chambers 8 to be minimised at the position A in FIG. 1 whilst providing the necessary fluid communication between the ports 23 and 25 and the chambers 8.

Optionally the inside surface of the wall 1 of the drum 13 may be provided with inwardly directed blades or lobes 13A so that lower speeds of rotation of the rotor can be used to support given pressure differences.

Figure 3:
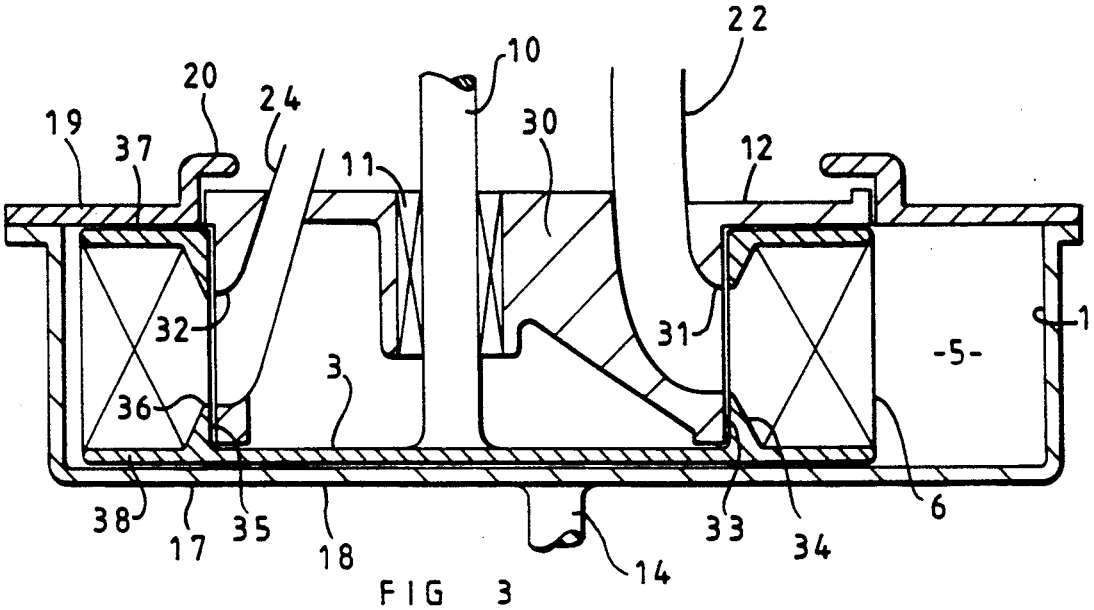
FIG. 3 is an axial section through a liquid ring assembly forming part of a second embodiment of the invention.

FIG. 3 shows an alternative embodiment in accordance with the invention which has different porting arrangements. In this embodiment the fixed port plate 12 is formed integrally with a fixed hub 30 through which the inlet and outlet ducts 22 and 24 extend so as to communicate with inlet and outlet ports 31 and 32 opening on an outer cylindrical surface 33 of the hub 30. In this case the vanes 6 are attached to an outer annular portion 34 of the rotor 3 which has an inner cylindrical surface 35 surrounding the outer cylindrical surface 33 of the hub 30, and the inlet and outlet ports 31 and 32 communicate with the chambers 8 by way of slots 36 extending through the rotor portion 34 between the vanes 6 and opening on the inner cylindrical surface 35.

In this embodiment shroud plates 37 and 38 are attached to the vanes 6 at each axial end of the rotor in order to decrease leakage between adjacent chambers 8. However, some leakage between adjacent chambers 8 will still take place by way of the slots 36 and the annular gap between the rotor portion 34 and the hub 30.

Figure 4:
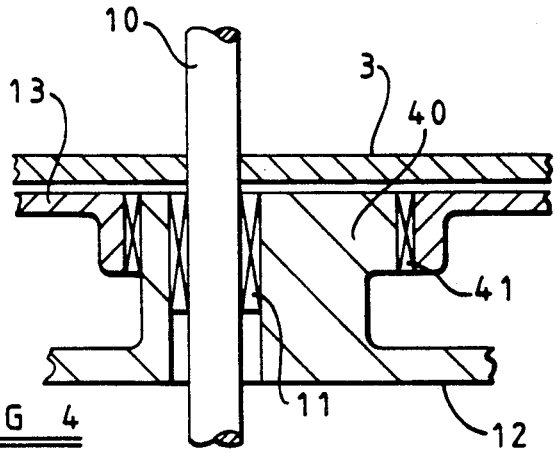
FIG. 4 is an axial section through part of a variant in accordance with the invention.

FIG. 4 shows a detail of a variant of the embodiment of FIG. 2 in which a bearing 11 for a lower end of the shaft 10 of the rotor 2 extends through a hub 40 integrally formed with the port plate 12, and the drum 13 is supported by an oversize drum bearing 41 surrounding the hub 40. A similar bearing arrangement (not shown) is provided for an upper end of the shaft 10 and incorporates a further oversize drum bearing 41. Such an arrangement avoids the need to provide an overhung rim 20 on the drum 13.

Any of the above-described liquid ring machines may be used with advantage in an engine to provide a relatively high power output for a relatively low total weight of the engine. The engine preferably operates on a constant pressure combustion cycle, and preferably comprises a liquid ring machine 50 and a combustion chamber 51 which is outside the liquid ring machine and provides continuous combustion, as shown diagrammatically in FIG. 5. The liquid ring machine in FIG. 5 comprises a compressor 52 and an expander 53 on a common shaft, both the compressor 52 and the expander 53 themselves being liquid ring machines and therefore positive displacement machines, that is to say machines which process a defined volume of gas through a defined volume ratio. It will be appreciated that air compressed by the compressor 52 is supplied to the air inlet of the combustion chamber 51, and that the combustion products outputted by the combustion chamber 51 are expanded by the expander 53, with the result that the compressor 52 is driven by the expander 53. There is no pressure rise in the combustion chamber so that the volume of working fluid supplied to the expander 53 is greater than the volume of working fluid outputted by the compressor 52 due to the temperature rise on combustion. The degree of increase of the volume of working fluid is dependent on the overall fuel/air mixture strength and may vary. Of course the output drive from the common shaft may serve a variety of purposes, such as to provide the drive for a microlight aircraft.

A number of different forms of such an engine are possible to suit different requirements, and some of these are shown diagrammatically in FIGS. 6 to 9. In these figures the liquid ring machines are shown schematically in the manner of FIG. 1 and the extent of the inlet and outlet ports is indicated by shading. The different engines may be classified according to whether the output shaft speed range is large or small, and according to whether the output torque range is large or small. It is preferable to maintain a high speed on the compressor shaft.

Figure 6:
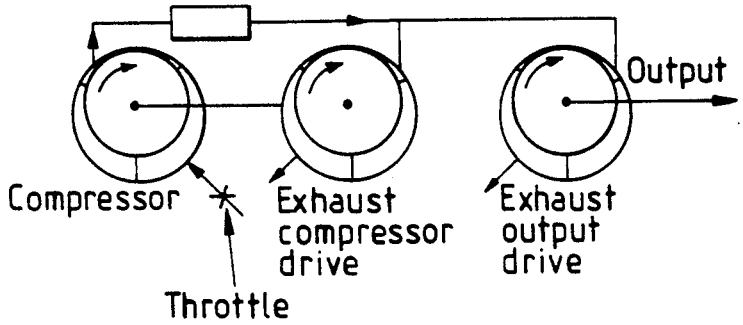

The engine of FIG. 6 makes use of a compressor and an expander on a common shaft, as well as a further expander provided on a separate drive shaft which is driven in parallel with the first expander. In this case the output drive is provided by the second expander, and the volume of the fluid outputted by the expander is dependent on the required speed of the drive shaft. This engine has both a wide speed range and a wide torque range, and is therefore very flexible in operation although its construction is complex.

Figure 5:
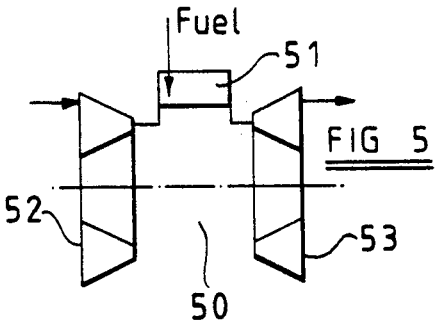
FIGS. 5 to 9 are diagrams illustrating the general layout of various liquid ring engines in accordance with the invention.
Figure 7:
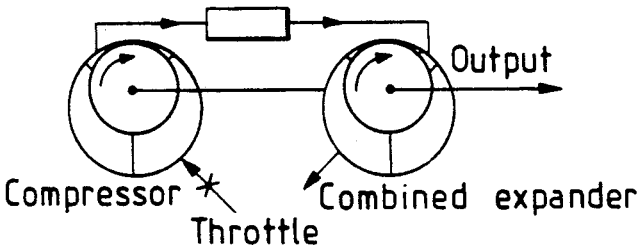

FIG. 7 shows an arrangement similar to that described with reference to FIG. 5 in which a single expander is provided both for driving the compressor and for providing the output drive. Such an engine provides a small speed range but a wide torque range.

Figure 8:
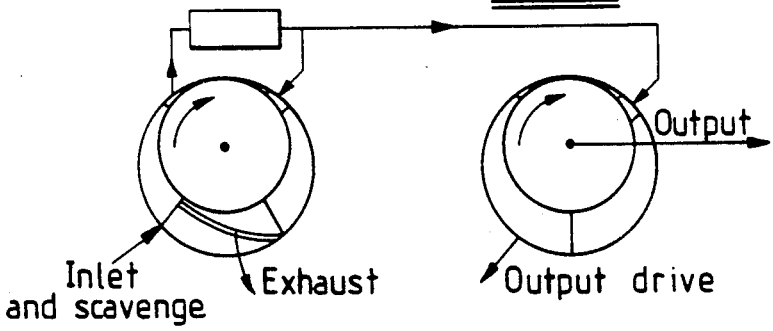

FIG. 8 shows an engine which is similar in broad principle to the engine of FIG. 6 but in which the compressor and the first expander are combined so that their functions are performed by a single liquid ring machine. As will be readily appreciated by referring to FIG. 8, the first 180° of the cycle of rotation of a rotor chamber of such a machine serves to compress the inlet air for combustion, whereas the final 180° of the rotor chamber cycle serves to expand the combustion products to drive the compressor. As in the arrangement of FIG. 6 an expander provided on a separate drive shaft provides the output drive. Such an engine has a wide speed range, but a narrow torque range.

Figure 9:
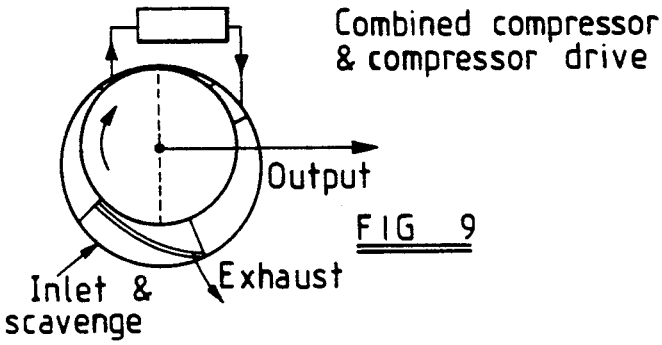

FIG. 9 shows an engine having a single liquid ring machine, but which again serves the dual function of a compressor and a compressor drive as described above. In this case the output drive is also supplied by the single liquid ring machine. Furthermore the porting will generally be chosen so that the inlet port to the expander portion provides "late port closing" to give the required working fluid volume, and the inlet port to the compressor portion provides "late port closing" to give a compression ratio similar to the expansion ratio. The engine of FIG. 9 provides both a narrow speed range and a narrow torque range.

It will be appreciated that engines, such as those of FIGS. 8 and 9, in which a single rotor provides both compression and expansion cannot readily be throttled to vary torque (and in this sense they are similar to two-stroke piston engines).

It is envisaged that those engines having their output drive provided by an expander on a separate shaft, such as the engines of FIGS. 6 and 8, can have some simple arrangement to provide rotation of the outer drum even when the output shaft, and hence the rotor, is stationary in order to maintain the integrity of the liquid ring. This would enable the wide speed range provided by such engines to include zero speed, and would provide at least some torque capability for starting from rest.

I claim:

1. A liquid ring machine having a plurality of liquid ring assemblies each comprising a drum having a cylindrical wall surrounding a central axis, a vaned rotor rotatable within the drum about an axis which is parallel to, but offset from, the central axis of the drum, and a liquid disposed within the drum such that, when the rotor rotates at a sufficient speed, the liquid forms a rotating ring adjacent the cylindrical wall of the drum and the ends of the vanes on the rotor are maintained in contact with the liquid during such rotation so that a series of chambers is formed between the vanes of the rotor, the chambers being bounded at the outer periphery by the liquid ring and varying in volume in dependence on the angular orientation of the rotor in view of the offset between the axis of rotation of the rotor and the central axis of the drum, and inlet and outlet means by means of which a working fluid is introduced into, and discharged from, each of the chambers at appropriate angular positions of the rotor, wherein at least the cylindrical wall of the drum is freely rotatable about the central axis to enable the cylindrical wall to be rotated by the liquid ring, wherein the liquid ring machine is a thermodynamic machine which comprises a liquid ring compression part having an inlet for fluid and an outlet for compressed fluid, and a liquid ring expansion part having an inlet for fluid and an outlet for expanded fluid, the liquid ring compression part and the liquid ring expansion part being formed by respective said liquid ring assemblies, wherein the liquid ring compression part and the liquid ring expansion part are mounted on separate drive shafts so as to be capable of rotating at different speeds, and wherein a further liquid ring expansion part having an inlet for fluid and an outlet for expanded fluid is mounted on a common drive shaft to the liquid ring compression part to drive the liquid ring compression part.

2. A machine according to claim 1, wherein the inside surface of the cylindrical wall of the drum is provided with radially inwardly directed blades or lobes.

3. A machine according to claim 1, wherein the rotor includes a shroud plate which extends perpendicularly to the axis of rotation of the rotor at one axial end of the rotor and which is joined to the corresponding axial end of each vane of the rotor.

4. A machine according to claim 1, wherein the drum comprises a dish-shaped base and an annular cover plate secured thereto, and the rotor is mounted on a shaft supported by bearings extending through a fixed plate within the annular cover plate, an annular seal being provided between the fixed plate and the cover plate to permit rotation of the drum relative to the fixed plate.

5. A machine according to claim 1, wherein the inlet and outlet means comprise inlet and outlet ducts extending through a port plate forming an axial end wall of the drum and communicate with the chambers.

6. A machine according to claim 1, wherein the inlet and outlet means comprise inlet and outlet ducts extending through a fixed hub and opening on an outer cylindrical surface of the hub so as to be communicable with the chambers by way of ports extending through the rotor and opening on an inner cylindrical surface of the rotor surrounding the outer cylindrical surface of the hub.

7. A machine according to claim 1, wherein it is an engine incorporating a combustion chamber having a fuel inlet, an air inlet, and a combustion outlet, wherein the inlet of the liquid ring compression part is adapted to receive air and the outlet of the liquid ring compression part is connected to supply compressed air to the air inlet of the combustion chamber, and the inlet of the liquid ring expansion part is connected to receive combustion products from the combustion outlet of the combustion chamber and the outlet of the liquid ring expansion part is adapted to exhaust expanded combustion products.

8. A machine according to claim 1, wherein the liquid ring compression part and a further liquid ring expansion part are formed in respective peripheral halves of the drum of a common liquid ring assembly.

* * * * *